US006431688B1

(12) United States Patent
Shin et al.

(10) Patent No.: US 6,431,688 B1
(45) Date of Patent: Aug. 13, 2002

(54) BACK-FLOW PREVENTION DEVICE AND METHOD FOR INK JET PRINTER

(75) Inventors: Kyu-Ho Shin; Sung-Hee Lee, both of Suwon (KR)

(73) Assignee: Samsung Electronics, Ltd., Suwon (KR)

( * ) Notice: Subject to any disclaimer, the term of this patent is extended or adjusted under 35 U.S.C. 154(b) by 0 days.

(21) Appl. No.: 09/664,524

(22) Filed: Sep. 18, 2000

(30) Foreign Application Priority Data

Nov. 4, 1999 (KR) ..... 99-48548

(51) Int. Cl.[7] ..... B41J 2/05; B41J 2/17
(52) U.S. Cl. ..... 347/65; 347/94
(58) Field of Search ..... 347/20, 44, 54, 347/65, 94, 67

(56) References Cited

U.S. PATENT DOCUMENTS 4,480,259 A * 10/1984 Kruger et al. ..... 347/54
5,097,275 A * 3/1992 Takita ..... 347/65

* cited by examiner

*Primary Examiner*—John Barlow
*Assistant Examiner*—Juanita Stephens
(74) *Attorney, Agent, or Firm*—Robert E. Bushnell, Esq.

(57) ABSTRACT

An inkjetting apparatus includes a nozzle module, a driving module, and a membrane. The nozzle module includes an ink chamber for reserving ink, and a nozzle hole for permitting ink in the ink chamber to be jetted therethrough. The driving module includes a working fluid chamber, and a heater located in the working fluid chamber. The membrane serves as a partition between the ink chamber and the working fluid chamber. The membrane includes an ink injecting hole for interconnecting an ink injecting passage through which the ink is fed from an external ink source, with the working fluid chamber, and an interconnecting hole for interconnecting the working fluid chamber with the ink chamber to permit ink in the working fluid chamber to be fed into the ink chamber. The ink injecting hole and/or the interconnecting hole have neck modules for narrowing the ink injecting hole and/or the interconnecting hole to a size smaller than the inner diameters of the ink chamber and the working fluid chamber, respectively. Due to the presence of the neck modules, the sizes of the ink injecting hole and/or the interconnecting hole are smaller than the inner diameters of the ink flowing passage, so that any back flow of ink is prevented during the ink jetting process.

6 Claims, 2 Drawing Sheets

BACK-FLOW PREVENTION DEVICE AND METHOD FOR INK JET PRINTER

CLAIM OF PRIORITY

This application makes reference to, incorporates the same herein, and claims all benefits accruing under 35 U.S.C. §119 from the inventor's application THERMAL-COMPRESS TYPE INK JETTING APPARATUS HAVING A NECK PART FOR PREVENT BACKFLOW OF INK filed with the Korean Industrial Property Office on Nov. 4, 1999 and there duly assigned Serial No. 48548/1999.

BACKGROUND OF THE INVENTION

1. Field of the Invention

The present invention relates to an output apparatus such as an inkjet printer or facsimile machine. More particularly, the invention concerns a device for use in a thermal-compression type fluid jet apparatus employed in a printer head, the device being adapted to prevent back-flow of ink. In addition, the invention concerns a method of preventing back-flow of ink by using the foregoing apparatus.

2. Description of the Related Art

Generally, a fluid jet apparatus employed in a printer head of an output apparatus, such as an inkjet printer or a facsimile machine, ejects ink from an ink chamber outward through a nozzle by exerting physical force to the ink chamber. Such a fluid jet apparatus may be of a thermal type, a piezoelectric type, or a thermal-compression type, depending on the method of exerting physical force on the fluid. This invention concerns the thermal-compression type of apparatus.

An example of a known thermal-compression type fluid jet apparatus is shown in FIG. 1. The fluid jetting apparatus includes a driving module 20, a membrane 30, and a nozzle module 40.

The driving module 20 includes a substrate 15, an oxide film 14 laminated onto substrate 15, a working fluid barrier 25 having a working fluid chamber 27, a heater 16 located in working fluid chamber 27, and a conductor 17 connected with the heater 16.

Nozzle module 40 includes an ink chamber barrier 45 having an ink chamber 57, and a nozzle plate 47 connected with the upper portion of ink chamber barrier 45. On the upper side of nozzle plate 47, a nozzle hole 49 is formed to permit ink in the ink chamber 57 to be forced therethrough as a jet.

Membrane 30 is disposed between ink chamber barrier 45 and working fluid barrier 25. Membrane 30 serves as a partition between the working fluid chamber and ink chamber 57.

The working fluid (such as a heptane or the like) is charged in working fluid chamber 27, while the ink is constantly fed into ink chamber 57 from an ink source (not shown in the drawings).

As electricity is applied to conductor 17, heat is generated by heater 16, and the working fluid in working fluid chamber 27 is heated, forming bubbles. The bubbles increase the pressure in working fluid chamber 27. Accordingly, membrane 30 is upwardly bent, imposing pressure on the ink in ink chamber 57. Accordingly, the ink in ink chamber 57 is forced through the nozzle holes 49.

The conventional fluid jet apparatus, however, has shortcomings. First, it requires a complicated manufacturing process: first, a working fluid preparing process; second, a working fluid charging process; and third, sealing process. Further, since the organic solvent employed as the working fluid (e.g., such as a heptane) is apt to evaporate easily, there is a high possibility of having a space in the working fluid chamber. Once a space is formed in the working fluid chamber, the pressure exerted on the membrane can become insufficient during the heating operation of the heater, so that the quantity of jetted ink can not be precisely controlled.

In order to solve the above-described shortcoming of the prior art, the present inventor has disclosed an ink jet apparatus using ink as the working fluid as shown in FIG. 2.

Referring to FIG. 2, a system with a driving module 120, a membrane 130, and a nozzle module 140 is similar to a conventional ink jetting apparatus, as shown in FIG. 1. Accordingly, driving module 120 includes a substrate 115, an oxide film 114, a working fluid barrier 125 forming a working fluid chamber 127, a heater 116, and a conductor 117. Nozzle module 140 includes an ink chamber barrier 145 having an ink chamber 157, and a nozzle plate 147 having a nozzle hole 149.

The ink jet apparatus shown in FIG. 2 has an interconnecting hole 135 formed in membrane 130. The ink is fed into ink chamber 157 from an external ink source (not shown), and also is fed into working fluid chamber 127 through interconnecting hole 135. Accordingly, the ink serves as the working fluid. As heater 116 heats the ink in working fluid chamber 127, bubbles B are produced in working fluid chamber 127, upwardly bending the membrane 130. Accordingly, the ink in ink chamber 157 is pressurized, and the ink is jetted through the nozzle hole 149.

In such a fluid jet apparatus, there is no need to separately prepare the working fluid since the ink is used as the working fluid. Also, there is no need for a sealing process with respect to working fluid chamber 127. Accordingly, some malfunctions of the fluid jet apparatus are prevented.

The above-described fluid jetting apparatus using the ink as the working fluid, however, has the following problems: First, the ink received in working fluid chamber 127 constantly serves as the working fluid. Hence, the temperature in working fluid chamber 127 keeps increasing by the repetitive heating operation of heater 116. Accordingly, the durability of the fluid jetting apparatus is shortened. Further, as the ink is pressured by the expansion of bubbles B, which are produced by the heating operation of heater 116, and as membrane 130 is upwardly bent, a back flow of the ink occurs from working fluid chamber 127 outside of working fluid chamber 127 through interconnecting hole 135. Accordingly, the appropriate quantity of ink may not be maintained in working fluid chamber 127. When the ink is next jetted through nozzle hole 149 by the heating operation of heater 116, the jet pressure of the ink may be decreased. Accordingly, the desired quantity of ink is not jetted, and the print quality deteriorates when performing repetitious printing operations.

SUMMARY OF THE INVENTION

Accordingly, an object of the present invention is to provide an improved ink jet apparatus capable of preventing occurrence of temperature increase in the working fluid chamber as a result of use of the ink to serve as the working fluid. A further object is to prevent a back flow of ink into the ink chamber and the working fluid chamber.

The present invention accomplishes the above objects in a thermal-compression type inkjet apparatus having components as described above. These components include a nozzle module having an ink chamber, a nozzle hole for permitting the ink in the ink chamber to be jetted therethrough; a driving module having a working fluid chamber, the driving module having a heater disposed in the working fluid chamber; a membrane serving as a partition between the ink chamber and the working fluid chamber. The membrane in the device of the invention is provided with an ink injecting hole for interconnecting an ink injecting passage through which ink is fed from an external ink source. Also, an interconnecting hole interconnects the working fluid chamber with the ink chamber to permit the ink in the working fluid chamber injected through the ink injecting hole to be fed into the ink chamber. Further, the ink injecting hole and/or the interconnecting hole have neck modules, respectively, for narrowing the ink injecting hole and the interconnecting hole to sizes smaller than the inner diameters of the working fluid chamber and the ink chamber.

According to the present invention, the sizes of the ink injecting hole and the interconnecting hole are narrowed to be smaller than the inner diameters of the places where the ink flows. Therefore, the back flow of ink is prevented during the ink jetting process. Further, since the ink serving as the working fluid is constantly fed into the working fluid chamber, excessive heat in the working fluid chamber is prevented, and the durability of the inkjet apparatus is improved.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components.

DETAILED DESCRIPTION OF THE PREFERRED EMBODIMENTS

Figure 1:
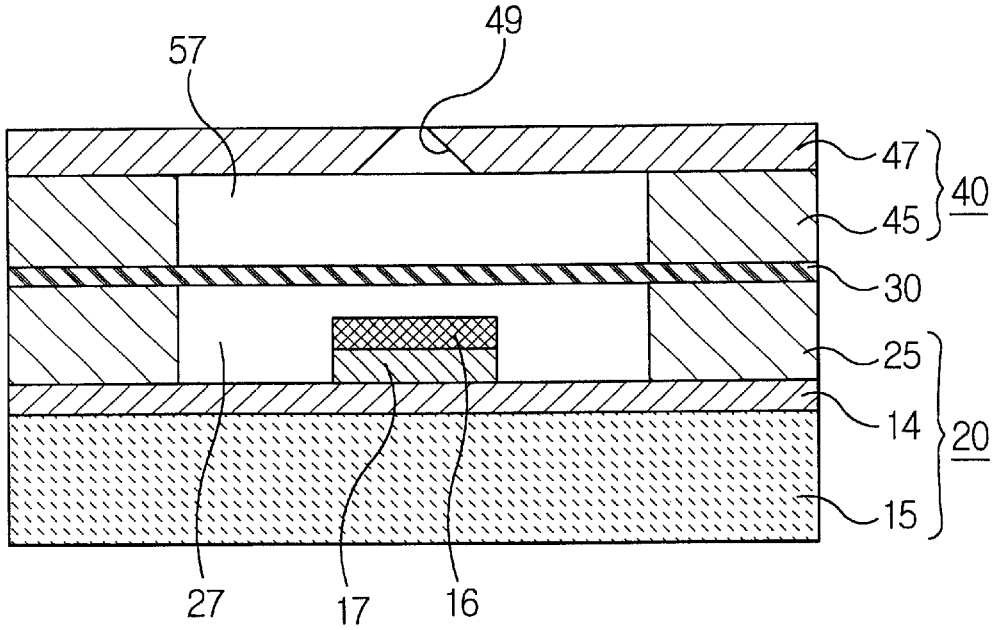
FIG.1 (PRIOR ART)
FIG. 1 is a sectional view of a conventional ink jetting apparatus.
Figure 2:
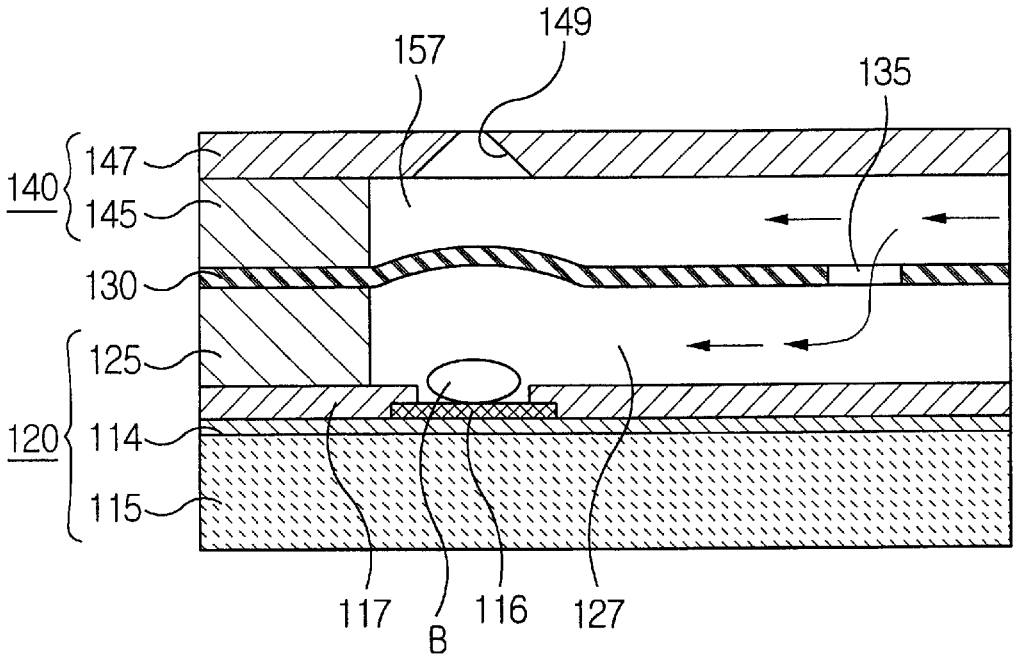
FIG. 2 is a sectional view of a related art ink jetting apparatus.
Figure 3:
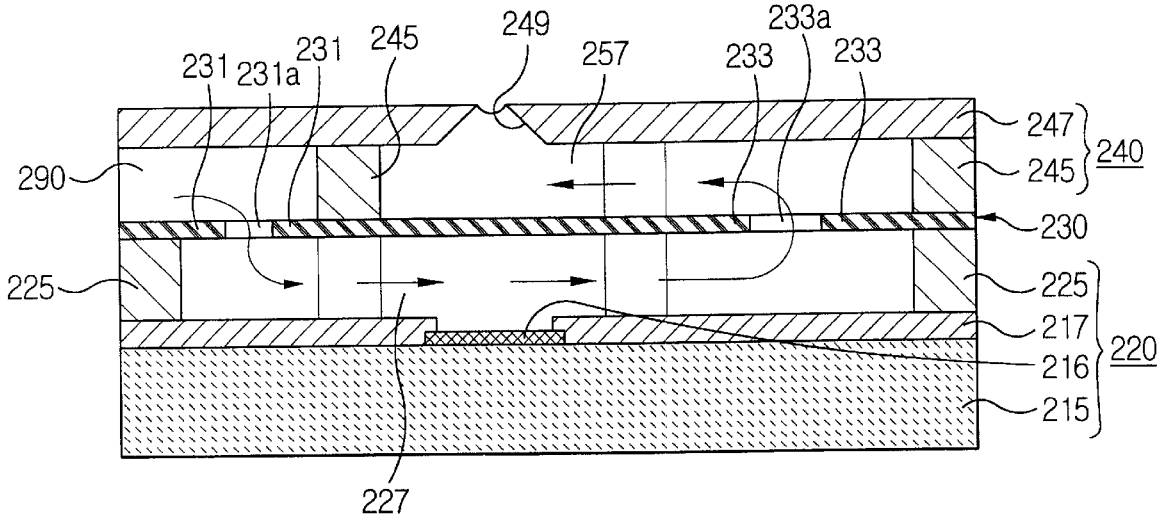
FIGS. 3 and 4 are sectional views of an ink jetting apparatus according to the present invention.

FIG. 3 shows a thermal-compression type ink jetting apparatus according to the present invention. Like the conventional fluid jetting apparatus, the fluid jetting apparatus according to the present invention includes a driving module 220, a membrane 230, and a nozzle module 240.

The driving module includes a substrate 215, a working fluid chamber barrier 225 having a working fluid chamber 227, a heater 216 disposed in the working fluid chamber 227, and a conductor 217 connected with heater 216.

The nozzle module includes an ink chamber barrier 245 having an ink chamber 257, and a nozzle plate 247 connected with the upper side of ink chamber barrier 245. On nozzle plate 247, a nozzle hole 249 is bored to correspond with ink chamber 257.

The membrane is located between ink chamber barrier 245 and working fluid chamber barrier 225. Membrane 230 serves as a partition between working fluid chamber 227 and ink chamber 257.

An ink injecting passage 290 is formed at one side of ink chamber 257. The ink injecting passage is connected with an external ink source (not shown). The membrane has an ink injecting hole 231*a* and an interconnecting hole 233*a* formed therein. Ink injecting hole 231*a* interconnected with ink injecting passage 290 through which ink is fed from an external ink source (not shown), with working fluid chamber 227. Interconnecting hole 233*a* interconnects working fluid chamber 227 with ink chamber 257. Ink injecting hole 231*a* and interconnecting hole 233*a* formed in membrane 230 are opposite to each other in working fluid chamber 227. Accordingly, working fluid chamber 227 actually has two open opposite sides.

The ink flows in from the ink source (not shown) through ink injecting passage 290, and flows into working fluid chamber 227 through ink injecting hole 231*a*. Then the ink charged in working fluid chamber 227 flows into ink chamber 257 through interconnecting hole 233*a*.

Around ink injecting hole 231*a,* a neck module 231 is formed, to narrow the ink injecting hole 231*a* to a size smaller than the inner diameter of the working fluid chamber 227. Neck module 231 prevents back flow of the ink from working fluid chamber 227 to ink injecting passage 290. Further, a second neck module 233 is formed around interconnecting hole 233*a,* to narrow interconnecting hole 233*a* to a size smaller than the inner diameter of ink chamber 257. Neck module 233 prevents back flow of ink from the ink chamber 257 to working fluid chamber 227.

In order to charge ink in the working fluid chamber 227 and ink chamber 257 through ink injecting passage 290, a vacuum device is first connected to ink injecting passage 290, to empty the inner space of working fluid chamber 227 and ink chamber 257. Then, the ink source is connected to ink injecting passage 290. Ink is then charged into ink injecting passage 290, ink injecting hole 231 a, working fluid chamber 227, interconnecting hole 233*a,* and ink chamber 257 from the ink source.

Figure 4:
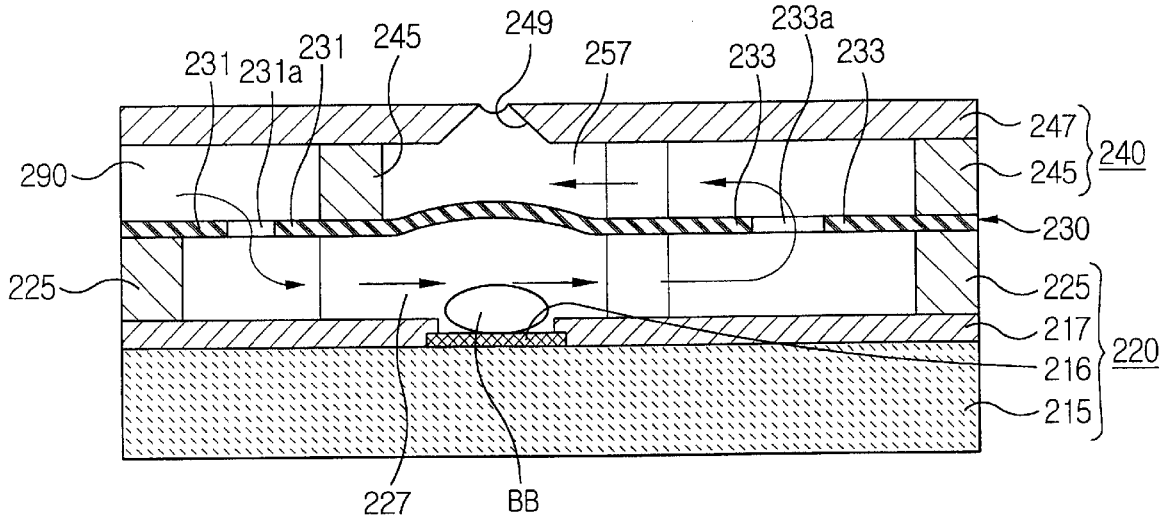

FIG. 4 shows the actual operation of the inkjet apparatus of the present invention. As electricity is applied to the conductor 217 (see FIG. 3), heater 216 generates heat. The ink in working fluid chamber 227 is heated, forming bubbles BB as shown in FIG. 4. The bubbles BB hence the volume of the working fluid chamber 227. As shown in FIG. 4, membrane 230 is upwardly bent to pressurize the ink in ink chamber 257. Accordingly, ink in the ink chamber 257 is forced through nozzle hole 249.

The increasing pressure in ink chamber 257 during the upward bending of the membrane 230 tends to force the ink in ink chamber 257 back to the working fluid chamber 227 through the interconnecting hole 233*a*. However, since neck part 233 narrows the size of the interconnecting hole 233*a* to be smaller than the inner diameter of ink chamber 257, back flow of ink is prevented. The ink therefore jets through nozzle hole without pressure loss due to lack back flow.

Further, the pressure increase in working fluid chamber 227 during the production of s bubbles BB forces the ink in working fluid chamber 227 back to ink injecting passage 290 through ink injecting hole 231*a*. Here, since the size of ink injecting hole 231 a is narrowed to be smaller than the inner diameter of the working fluid chamber 227 by neck module 231, back flow of ink is prevented. Accordingly, pressure in working fluid chamber 227 is appropriately maintained to pressurize membrane 230 during the heating operation of heater 216.

As heater 216 stops its heating operation, membrane 230 recovers its initial state as shown in FIG. 3. Accordingly, pressure in ink chamber 257 is decreased, and ink in working fluid chamber 227 flows into ink chamber 257 through interconnecting hole 233*a*. Ink is newly fed from the ink source to working fluid chamber 227 through ink injecting passage 290 and ink injecting hole 231*a*. Since ink is constantly being fed into working fluid chamber 227 whenever ink is jetted through the nozzle hole 249, working fluid chamber 227 is appropriately cooled by the newly fed ink even during repetitious heating operations of the heater 216. Accordingly, excessive heat in the working fluid chamber 227 is prevented, and the durability of the ink jetting apparatus is improved.

Since the sizes of ink injecting hole 231*a* and interconnecting hole 233*a* are narrowed to be smaller than the inner diameters of the places where the ink flows, back flow of ink is prevented during the ink jet process. Further, since ink serving as the working fluid is constantly fed into working fluid chamber 227, excessive heat in working fluid chamber 227 is prevented, and the durability of the ink jetting apparatus is improved.

While the invention has been described in connection with specific and preferred embodiments thereof, it is capable of further modifications without departing from the spirit and scope of the invention. This application is intended to cover all variations, uses, or adaptations of the invention, following, in general, the principles of the invention and including such departures from the present disclosure as come within known or customary practice within the art to which the invention pertains, or as are obvious to persons skilled in the art, at the time the departure is made. It should be appreciated that the scope of this invention is not limited to the detailed description of the invention hereinabove, which is intended merely to be illustrative, but rather comprehends the subject matter defined by the following claims.

What is claimed is:

1. In a thermal-compression ink jet apparatus, comprising:

a nozzle module having an ink chamber for containing ink and a nozzle hole for permitting the ink in the ink chamber to jet therethrough;

a driving module having a working fluid chamber in which is located a heater; and a membrane to provide a partition between the ink chamber and the working fluid chamber, the membrane having an ink injecting hole through which ink is fed to the working fluid chamber from an external ink source;

the improvement comprising:

locating in the membrane an interconnecting hole that interconnects the working fluid chamber and the ink chamber, thereby providing a path via which ink in the working fluid chamber is fed into the ink chamber; and locating within the ink injecting hole, a neck part adapted for narrowing the ink injecting hole to a size smaller than the inner diameter of the working fluid chamber, whereby back flow of ink from the working fluid chamber to the ink injecting passage is prevented.

2. The apparatus of claim 1, wherein the interconnecting hole comprises a neck part adapted for narrowing the interconnecting hole to a size smaller than the inner diameter of the ink chamber, whereby back flow of ink from the ink chamber to the working fluid chamber is prevented.

3. In a thermal-compression type inkjetting apparatus comprising:

a nozzle module having an ink chamber for reserving ink, and a nozzle hole for permitting ink in the ink chamber to be jetted therethrough;

a driving module for forming a working fluid chamber, the driving module having a heater located in the working fluid chamber; and a membrane serving as a partition between the ink chamber and the working fluid chamber, the membrane having an ink injecting hole through which ink is fed from an external ink source to the working fluid chamber;

the improvement comprising:

locating in the membrane an interconnecting hole that interconnects the working fluid chamber and the ink chamber, thereby providing a path via which ink in the working fluid chamber is injected through the interconnecting hole to the ink chamber, and locating within the interconnecting hole, a neck part adapted for narrowing the interconnecting hole to a size smaller than the inner diameter of the ink chamber to prevent any back flow of ink from the ink chamber to the working fluid chamber.

4. The apparatus of claim 3, wherein the ink injecting hole comprises a neck part adapted for narrowing the ink injecting hole to a size smaller than the inner diameter of the ink chamber, whereby back flow of ink from the working fluid chamber into the external ink source is prevented.

5. A method for preventing back flow of ink within a thermal-compression ink jet apparatus, a nozzle module having an ink chamber for containing ink and a nozzle hole for permitting the ink in the ink chamber to jet therethrough; a driving module having a working fluid chamber in which is located a heater; and a membrane to provide a partition between the ink chamber and the working fluid chamber, the membrane having an ink injecting hole through which ink is fed to the working fluid chamber from an external ink source; said method comprising the following steps:

(1) locating in the membrane an interconnecting hole that interconnects the working fluid chamber and the ink chamber, thereby providing a path via which ink in the working fluid chamber is fed into the ink chamber; and (2) locating within the ink injecting hole, a neck part adapted for narrowing the ink injecting hole to a size smaller than the inner diameter of the working fluid chamber, whereby back flow of ink from the working fluid chamber to the ink injecting passage is prevented.

6. A method for preventing back flow of ink within a thermal-compression ink jet apparatus, said apparatus comprising a nozzle module having an ink chamber for reserving ink, and a nozzle hole for permitting ink in the ink chamber to be jetted therethrough;

a driving module for forming a working fluid chamber, the driving module having a heater located in the working fluid chamber; and a membrane serving as a partition between the ink chamber and the working fluid chamber, the membrane having an ink injecting hole through which ink is fed from an external ink source to the working fluid chamber;

said method comprising the following steps:

(1) locating in the membrane an interconnecting hole that interconnects the working fluid chamber and the ink chamber, thereby providing a path via which ink in the working fluid chamber is injected through the interconnecting hole to the ink chamber, and (2) locating within the interconnecting hole, a neck part adapted for narrowing the interconnecting hole to a size smaller than the inner diameter of the ink chamber to prevent any back flow of ink from the ink chamber to the working fluid chamber.

* * * * *